US006672588B1

(12) United States Patent
Kielar et al.

(10) Patent No.: US 6,672,588 B1
(45) Date of Patent: Jan. 6, 2004

(54) INTERLOCKING PUZZLE HAVING BACKSIDE PATTERN

(76) Inventors: Ronald F. Kielar, P.O. Box 453, Clinton, NY (US) 13323; Sue E. Kielar, P.O. Box 453, Clinton, NY (US) 13323

( * ) Notice: Subject to any disclaimer, the term of this patent is extended or adjusted under 35 U.S.C. 154(b) by 0 days.

(21) Appl. No.: 10/196,905

(22) Filed: Jul. 18, 2002

(51) Int. Cl.[7] ..... A63F 9/10
(52) U.S. Cl. ..... 273/157 R
(58) Field of Search ..... 273/157 R, 153 R, 273/156

(56) References Cited

U.S. PATENT DOCUMENTS 760,384 A * 5/1904 Dieterich ..... 273/157 R
802,807 A * 10/1905 Fitch ..... 273/157 R
1,907,382 A * 5/1933 Birdsall ..... 273/157 R
1,948,962 A * 2/1934 Schacht ..... 273/157 R
1,960,216 A * 5/1934 Decker ..... 273/157 R
4,422,642 A 12/1983 Fletcher
5,368,301 A * 11/1994 Mitchell ..... 273/157 R
5,743,741 A 4/1998 Fife
5,957,454 A 9/1999 Libeskind
6,336,631 B1 * 1/2002 Volkert ..... 273/157 R

* cited by examiner

*Primary Examiner*—Steven Wong
(74) *Attorney, Agent, or Firm*—David Giglio

(57) ABSTRACT

There is described an interlocking puzzle which can be separated into various sections according to backside marking pattern prior to solving. After separating the pieces into various sections each section is then individually solveable. In one embodiment the backsides of the individual interlocking pieces include a color or other pattern to identify each piece with a particular section. Each section can then be solved individually.

18 Claims, 7 Drawing Sheets

INTERLOCKING PUZZLE HAVING BACKSIDE PATTERN

FIELD OF THE INVENTION

The present invention relates generally to interlocking puzzles and, more particularly, to an interlocking puzzle that can be sectioned for easier solution according to a backside pattern.

BACKGROUND OF THE PRESENT INVENTION

Interlocking puzzles are known by people of all age groups and nationalities. Generally, parents teach small children to fit one piece puzzles together by shape, color and size and then gradually increase the complexities of the puzzles to suit the age and development of the child. In turn many adults enjoy building puzzles to challenge their minds, pass time and for other reasons.

U.S. Pat. No. 4,422,642 to Fletcher describes an educational puzzle that depicts mathematical problems and solutions on the final two dimensional front face design. Fletcher teaches color coding the columns of the front face of the puzzle to assist in solving the puzzle. However, color coding the front restricts the types and designs that can be placed on the front face design.

U.S. Pat. No. 5,439,221 to Harvie teaches an interlocking puzzle where many of the pieces include the very similar three dimensional size and shapes. Therefore, many of the pieces are interchangeable. This puzzle can be solved a countless number of ways. Alternatively, it can only be solved by fitting the picture together with no regard for the dimensions of the tabs and recesses of the interlocking pieces.

U.S. Pat. No. 5,743,741 to Fife discloses a math jigsaw puzzle that posts various two dimensional mathematical expressions on its final front face design.

U.S. Pat. 5,957,454 to Libeskind shows a jigsaw puzzle that is more complex to solve than jigsaw puzzles of the prior art because each puzzle piece has four edges that are directly in contact with only one edge from a single other puzzle piece. Therefore, most of the pieces appear similarly shaped.

Each of the above puzzles either shows a method of teaching the end user problems and solutions as created by the design on the puzzle front face or shows a jigsaw puzzle that is very complex to solve because most of the pieces appear similarly shaped with many other pieces. Therefore, each of the above puzzles is designed for one end user for educational or challenging purposes. Further, each of the above identified puzzles must be solved using one continuous table or surface.

SUMMARY OF THE INVENTION

It is an object of the present invention to improve the art of interlocking puzzles.

It is another object of the present invention to provide a means for solution that are not available in the prior art.

It is also an object of the present invention to provide puzzles that can be solved using group participation.

It is a further object of the present invention to provide an interlocking puzzle in which persons having differing levels of puzzle skill, including small children, can contribute toward the final solution.

It is yet a further object of the present invention to provide a puzzle that can be solved using a number of smaller tables or surfaces.

It is yet another object of the present invention to provide an interlocking puzzle that can be simultaneously solved by a number of persons working independently.

It is still yet another object of the present invention to provide a method and means of realistically solving a puzzle that can be wall sized.

It is still yet a further object of the present invention to provide a means for assisting in the solution of a particularly complex portion of a puzzle.

These and other objects are provided in accordance with the present invention in which there is provided an interlocking puzzle that has a two dimensional design on its front surface when each of the interlocking puzzle pieces is properly joined together. The backside of the puzzle is visually broken into a plurality of sections. Each piece that belongs to a particular section includes a backside marking pattern that correlates that piece with that particular section. Transitional pieces that would correlate with two or more sections can include marking patterns from each of the two or more sections or can include markings from just one particular section.

BRIEF DESCRIPTION OF THE DRAWINGS

The above and other objects of the present invention will be better understood by reading the following detailed description of the preferred embodiments of the invention, when considered in connection with the accompanying drawings, in which.

DETAILED DESCRIPTION OF THE PREFERRED EMBODIMENT

Figure 1:
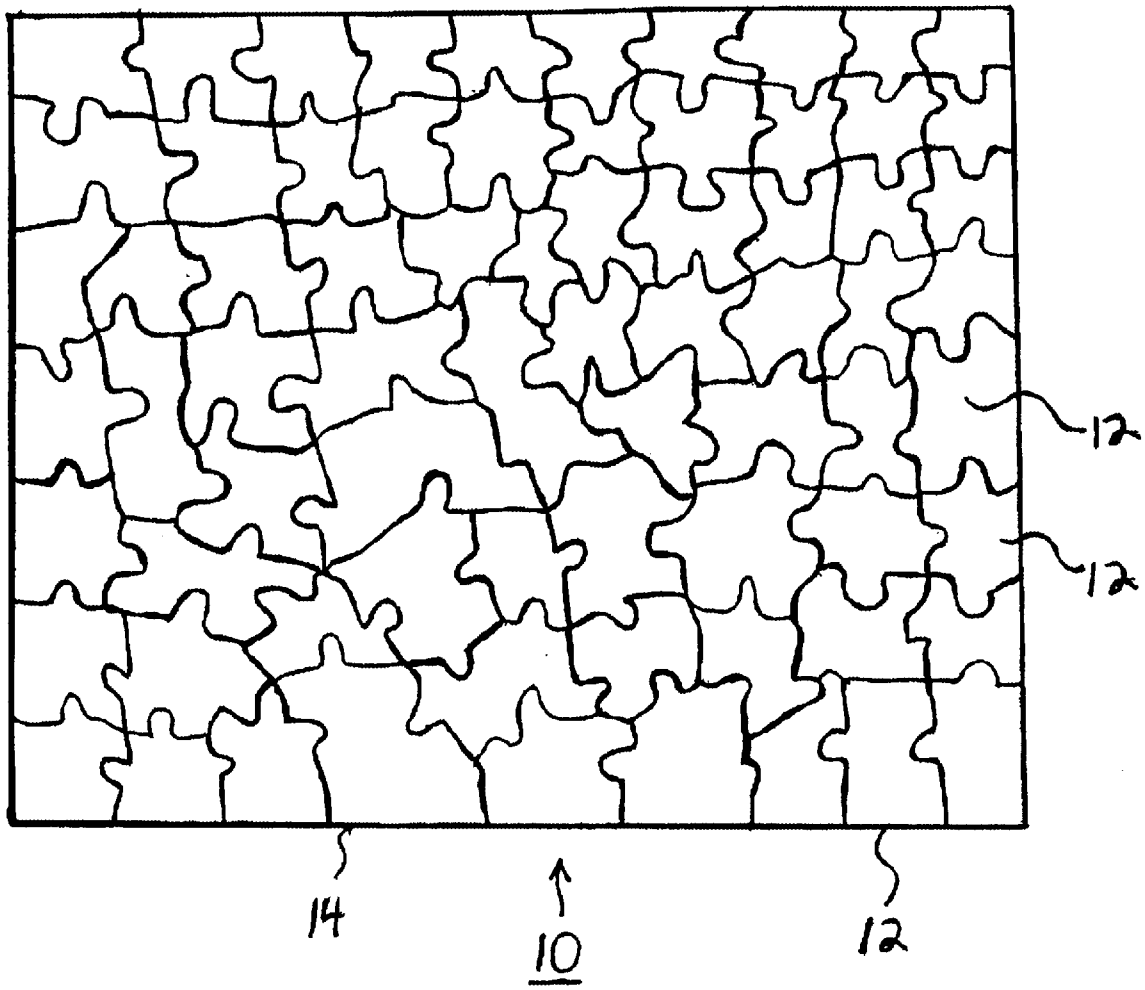
FIG. 1 shows a two dimensional design as depicted on the front face of a finished interlocking puzzle.

Referring now to FIG. 1 there is shown a puzzle 10 having each of a plurality of interlocking pieces 12 properly pieced together. The front face 14 of the puzzle 10 typically creates a scenic impression.

Figure 2:
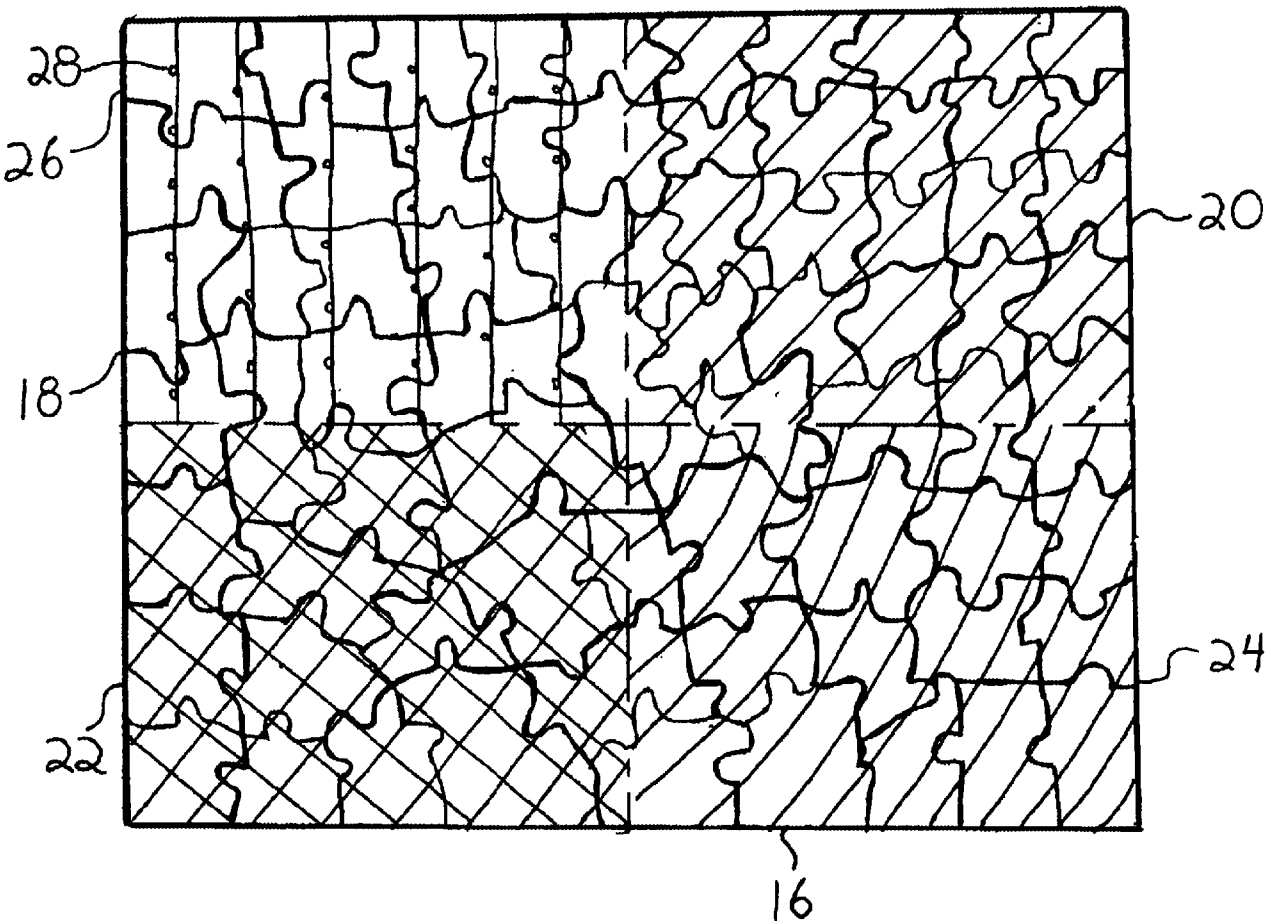
FIG. 2 shows a two dimensional arrangement of marking patterns on the backside of the interlocking puzzle of FIG. 1 in accordance with the present invention.

Turning now to FIG. 2, there is depicted a backside 16 of the puzzle 10. In the scenario of this example, the backside 16 includes a plurality of sections 18, 20, 22 and 24. A single piece 12 of a certain section includes a certain marking pattern that allows the user to determine which piece belongs in part or wholly to a certain section.

Looking at FIG. 2, the backside 16 of the pieces of section A 18 include curly cue imprints 28 to denote that each piece 26 belongs in whole or in part to section A 18. The curly cue imprint 28 is a stamped or raised design which allows a user to differentiate the pieces from Section B 20, Section C 22 and Section D 24.

Any other designs, imprints or raised features could also be used to differentiate pieces of Section A 18. For example, the backside 16 of each puzzle section could be color-coded such that each piece 12 of a particular section includes a specific color that is representative of that section. For example, the backside 16 of the pieces of puzzle Section A 18 are black, Section B 20 are white, Section C 22 are red and Section D 24 are blue.

Figure 4:
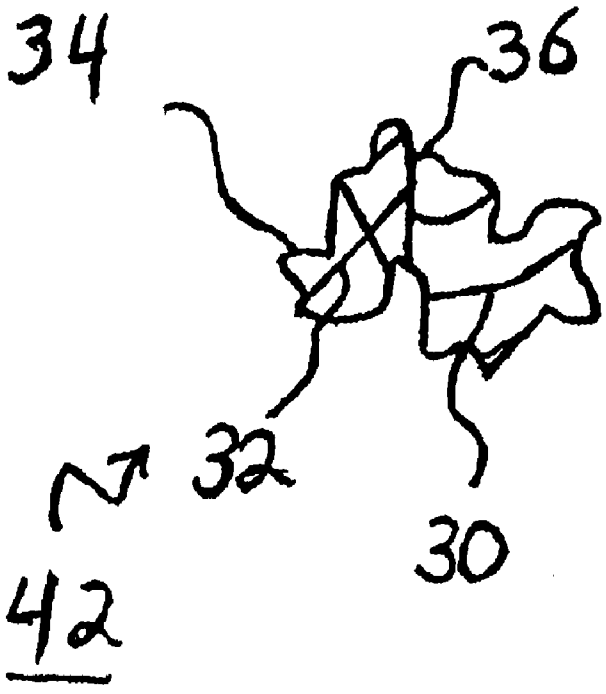
FIG. 4 shows a first embodiment of the backside of a transition puzzle piece of FIGS. 2 and 3.

Turning now to FIG. 4, there is shown a backside 30 of a transition puzzle piece 42 that belongs to both Section C 22 and Section D 24. The backside 30 of the transition puzzle piece 42 includes separate designs, imprints, raised features or colors to identify as belonging to more that one section. In this particular example, the transition piece 42 contains markings which are typical of marking patterns 32 of Section C 22 and a marking patterns 34 which are typical of Section D 24. As an added feature the two marking patterns 32, 34 can be separated with a bifurcation line 36.

Figure 5:
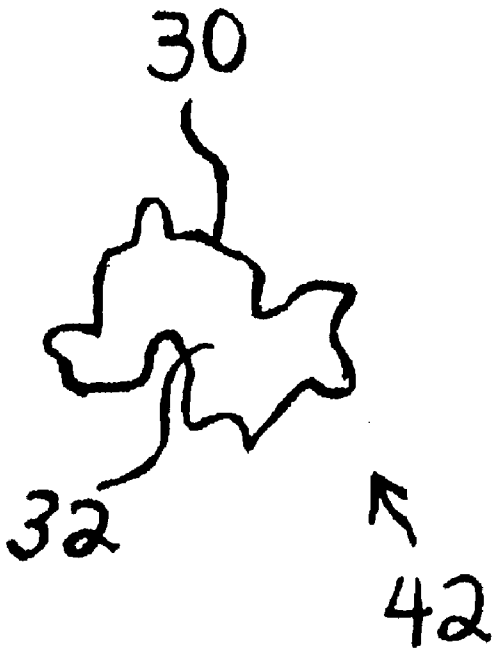
FIG. 5 shows an alternative embodiment of the backside of a transition puzzle piece of FIGS. 2 and 3.

Alternatively, the transition puzzle piece 42 contains wholly only one marking pattern from one of the puzzle sections. In FIG. 5, the transition piece contains wholly diamond shape configurations 32 representative of puzzle Section C 22.

Figure 6:
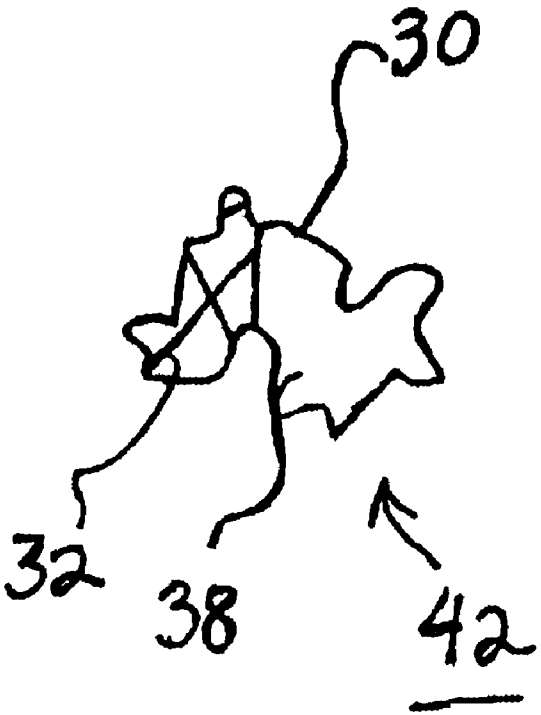
FIG. 6 shows another alternative embodiment of the backside of a transition puzzle piece of FIGS. 2 and 3.

In yet another alternative embodiment, the transition piece 42 contains in part only one marking pattern from one of the puzzle sections. In FIG. 6, the transition piece contains in part the diamond shape configuration 32 representative of puzzle Section C 22. The rest of the piece is blank 38, therefore, identifying it as a transition piece 42.

In certain situations the transition piece 42 may belong to three or even four puzzle sections. In these situations the backside 30 can include marking patterns that symbolize from one to all three or four of the puzzle sections.

It should be understood that the number of sections of the puzzle can be any number. For example, a five hundred piece puzzle can consist of four sections of one hundred and twenty five pieces. Alternatively the same five hundred piece puzzle may have three one hundred and four fifty piece sections. In one particular embodiment, the same five hundred piece puzzle has twenty sections each having twenty five pieces. Obviously, the more sections in a particular puzzle results in an easier and quicker solution.

In use, one or a number of persons building the puzzle 10 turns each puzzle piece 12 to its backside 16. Then each puzzle piece 12 is separated into a section according to its backside marking pattern. Each section is then given to a particular person. Alternatively, one person solves each section one at a time. To solve an individual puzzle section, the puzzle solver(s) turns each piece of that section back over and solves according to the front face design.

Figure 3:
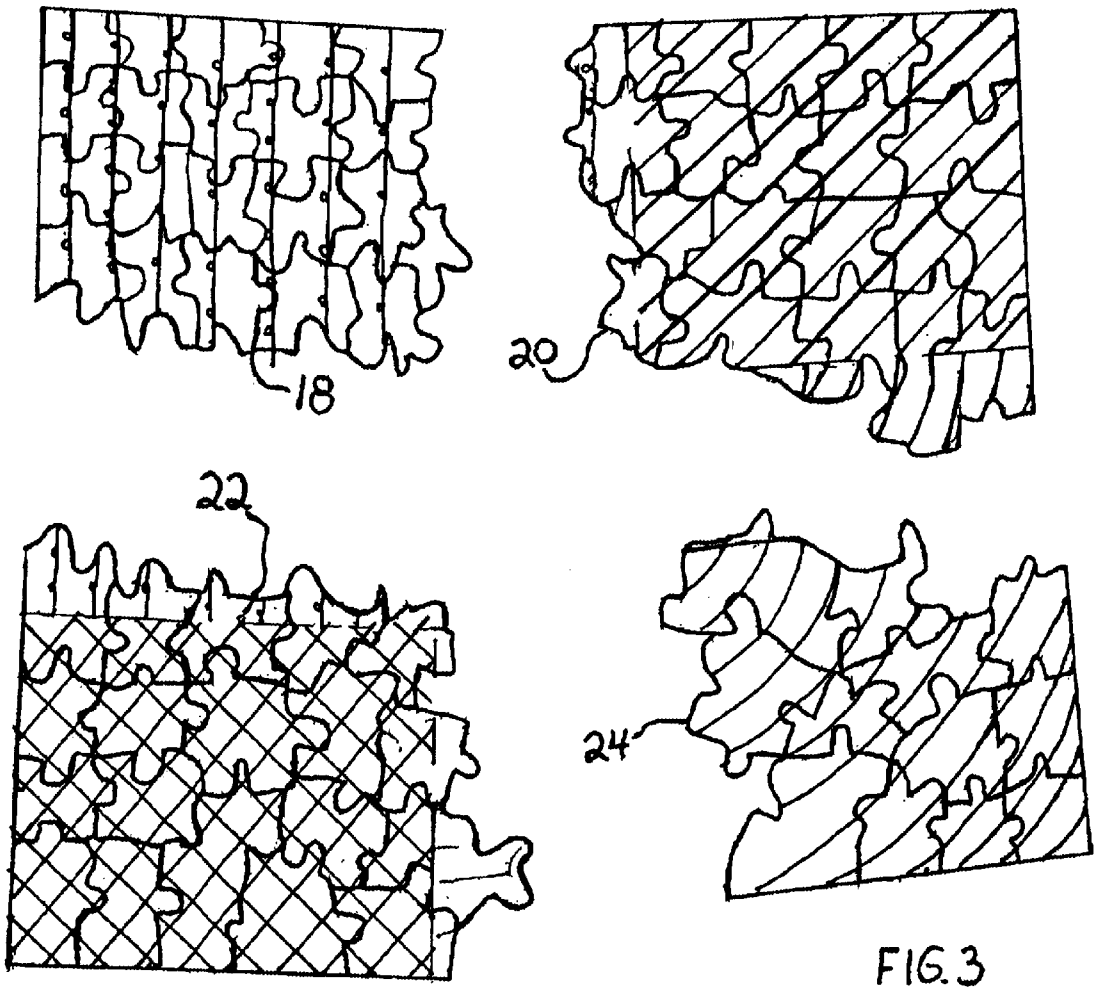
FIG. 3 shows individual finished sections of the interlocking backside of FIG. 2.

In one example represented by FIG. 3, the backside 16 of the puzzle 10 is sorted into four sections. A first person is assigned to solve Section A 18, a second person is assigned to solve Section B 20, a third person is assigned to solve Section C 22 and a fourth person is assigned to solve Section D 24.

After each person solves their particular puzzle section the sections are combined to form the complete puzzle 10. The puzzle 10 has now become a group experience that can be shared by a whole family.

Often times puzzle doers become stuck on various pieces or gaps in the front design when attempting to solve the puzzle. By having the capability of identifying a particular puzzle piece 12 with a particular section, it becomes easier to solve the puzzle 10 when a person becomes stuck part way through the puzzle 10.

A brief object of the present invention is that solving the puzzle 10 can be a group experience that is shared by members of differing puzzle solving skill levels. It is common for families to get together during holidays to socialize. As is known in the art, each individual puzzle piece 12 contains a part of a picture or scene. Therefore, when the puzzle 10 is completely installed the front face forms an image of a picture or scene. As a result, puzzle solving is a great way to come together.

In one example, the youngest or most inexperienced puzzle solvers can empty the puzzle 10 from its container, turn each piece 12 onto its front so that its backside 16 faces upward, and then sort the pieces 12 into their proper sections.

Next, each section is assigned to a puzzle solver or a group of puzzle solvers. The groups or individuals can compete to see who can solve a section quicker. After solving each individual section, the puzzle 10 is put together to form the final solution.

Figure 7:
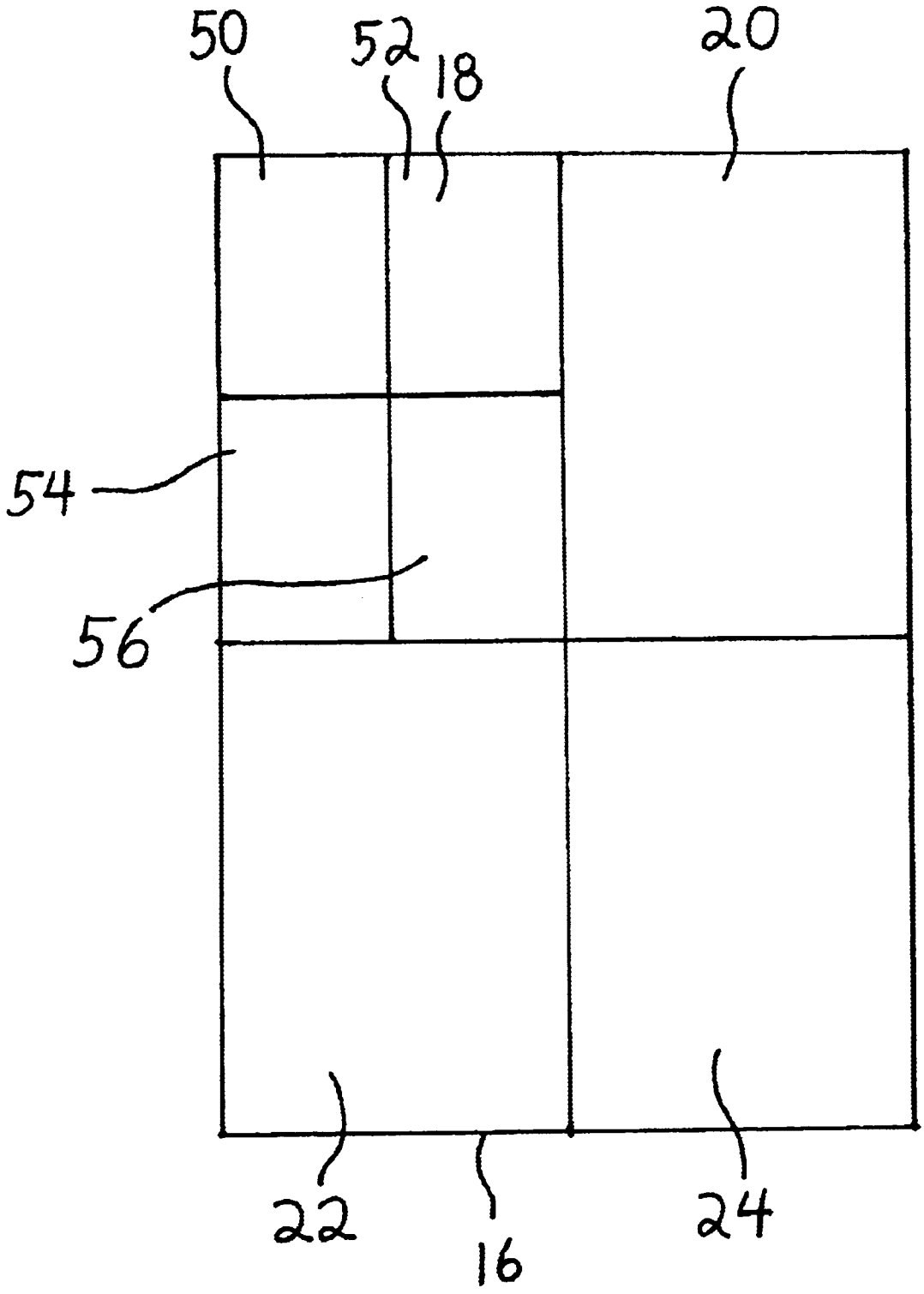
FIG. 7 shows yet another alternative embodiment of the backside of the puzzle of FIG. 1 wherein each puzzle section is subdivided into subsections.

Turning now to FIG. 7, there is shown yet another embodiment of the present invention. The backside 16 includes sections A 18, B 20, C 22 and D 24. Section A 18 is further subdivided into subsection Al 50, subsection A2 52, subsection A3 54 and subsection A4 56. Section A 18 includes a background color, for example red. Subsection Al 50 further includes a first shape, while subsection A2 includes a second shape, subsection A3 includes a third shape and subsection A4 includes a fourth shape. Therefore, the puzzle is sorted a first time into sections and each section can optionally be sorted a second time into subsections for easier solution.

Finally, another feature of the present invention is that each individual section can be solved on a smaller surface than it would take to solve the puzzle as one unit.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

What is claimed is:

1. An interlocking puzzle comprising:

a plurality of interlocking pieces, wherein each of said interlocking piece has a front side and a back side; and a plurality of sections geographically disposed, said sections being individually solveable, wherein the backside of each of said plurality of pieces contains at least one marking pattern that identifies each of said plurality of interlocking pieces as belonging to at least one of said plurality of sections, wherein said at least one marking pattern is substantially common for each of the plurality of pieces of a particular section.

2. The puzzle of claim 1 wherein the at least one marking pattern includes a color pattern such that each puzzle section is represented by a single color pattern.

3. The puzzle of claim 1 wherein the at least one marking pattern includes a raised pattern such that each puzzle section is represented by a single raised pattern.

4. The puzzle of claim 1 wherein the at least one marking pattern includes a design pattern such that each puzzle section is represented by a single design pattern.

5. The puzzle of claim 1, wherein said plurality of interlocking pieces further includes at least one transition piece, wherein said at least one transition piece belongs to more than one puzzle section.

6. The puzzle of claim 5, wherein the back side of said at least one transition piece includes a marking pattern for each puzzle section that said at least one transition piece belongs to.

7. The puzzle of claim 6, wherein at least one bifurcation line forms a boundary between said marking patterns.

8. The puzzle of claim 5, wherein said at least one transition piece includes at least one marking that identifies said at least one transition piece to only one section.

9. The puzzle of claim 8, wherein said at least one marking includes a color pattern.

10. The puzzle of claim 8, wherein said at least one marking includes a raised pattern.

11. The puzzle of claim 8, wherein said at least one marking includes a design pattern.

12. A method of solving an interlocking puzzle, wherein said puzzle includes a plurality of interlocking pieces, wherein each of said interlocking piece has a front side and a back side, and a plurality of sections geographically disposed according to a final puzzle design, said sections being individually solveable, wherein the backside of each of said plurality of pieces contains at least one marking pattern that identifies each of said plurality of interlocking pieces as belonging to at least one of said plurality of sections, said method comprising:

placing each of said interlocking pieces onto the front sides so that their back sides are facing upward and visible;

separating each of said interlocking pieces into at least one of their respective sections by determining a particular section according to the at least one marking pattern wherein the at least one marking pattern is substantially common for each piece of the particular section;

solving each particular section individually; and combining each solved particular section to form one unit.

13. The method of claim 12, wherein said at least one marking pattern includes a color pattern such that each puzzle section is represented by a single color pattern and wherein the step of separating each of said interlocking pieces into at least one of their respective sections further includes the step of sorting each of said interlocking pieces by said color pattern.

14. The method of claim 12, wherein said at least one marking pattern includes a raised pattern such that each puzzle section is represented by a single raised pattern and wherein the step of separating each of said interlocking pieces into at least one of their respective sections further includes the step of sorting each of said interlocking pieces by said raised pattern.

15. The method of claim 12, wherein said at least one marking pattern includes a design pattern such that each puzzle section is represented by a single design pattern and wherein the step of separating each of said interlocking pieces into at least one of their respective sections further includes the step of sorting each of said interlocking pieces by said design pattern.

16. An interlocking puzzle comprising:

a plurality of interlocking pieces, wherein each of said interlocking piece has a front side and a back side;

a plurality of sections geographically disposed, said sections being individually solveable, wherein the backside of each of said plurality of pieces contains at least one pattern that identifies each of said plurality of interlocking pieces as belonging to at least one of said plurality of sections; and at least one interlocking transitional piece that belongs to at least two sections, said back side of said at least one interlocking transitional piece containing a pattern for each section that it belongs to.

17. The puzzle of claim 16, wherein said at least one pattern comprises a color pattern.

18. The puzzle of claim 16, wherein at least one of the plurality of sections includes a plurality of secondary marking patterns so that it can be subdivided into a plurality of subsections.

* * * * *